US007436372B2

(12) United States Patent
Abe

(10) Patent No.: US 7,436,372 B2
(45) Date of Patent: Oct. 14, 2008

(54) ANTENNA DEVICE AND ELECTRONIC EQUIPMENT COMPRISING THE ANTENNA DEVICE

(75) Inventor: Kazuaki Abe, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 11/634,463

(22) Filed: Dec. 5, 2006

(65) Prior Publication Data

US 2007/0132648 A1 Jun. 14, 2007

(30) Foreign Application Priority Data

Dec. 8, 2005 (JP) ..... 2005-354239
Sep. 29, 2006 (JP) ..... 2006-268049

(51) Int. Cl.
*H01Q 7/08* (2006.01)
*H01Q 1/12* (2006.01)

(52) U.S. Cl. ..... 343/788; 343/718; 343/787

(58) Field of Classification Search ..... 343/718, 343/787, 788
See application file for complete search history.

(56) References Cited

U.S. PATENT DOCUMENTS 6,134,188 A * 10/2000 Ganter et al. ..... 368/47
7,061,439 B1 * 6/2006 Minami et al. ..... 343/718
2006/0214866 A1 * 9/2006 Araki et al. ..... 343/788

FOREIGN PATENT DOCUMENTS

JP 2004-274609 A 9/2004

* cited by examiner

*Primary Examiner*—Hoang V Nguyen
(74) *Attorney, Agent, or Firm*—Frishauf, Holtz, Goodman & Chick, P.C.

(57) ABSTRACT

An antenna device, housed in a space of a case of an electronic equipment, the case having a surface in which an aperture is formed, includes a magnetic substance and a coil wound around the substance. The substance includes a coil winding portion and a pair of coil non-winding portions protruding from both ends of the winding portion and magnetically coupled with the winding portion. At least one of the coil non-winding portions is curved in an arc shape toward a distal end thereof from a base thereof so as to extend along an inner periphery of the space when the device is housed in the space and is viewed from the surface. The equipment further includes a circuit unit housed in the space, electrically connected to the device, and controlled on a basis of a signal inputted from the device, and a decorative plate closing the aperture.

22 Claims, 13 Drawing Sheets

| | BASE END • BACK COVER SIDE | PROJECTING END • BACK COVER SIDE | DECORATIVE PLATE SIDE | SIDE SURFACE SIDE | INCREASE OF RECEIVING VOLTAGE |
|---|---|---|---|---|---|
| (A) | 0 SHEET | 1 SHEET | 0 SHEET | 0 SHEET | +1.4dB |
| (B) | 0 SHEET | 3 SHEETS | 0 SHEET | 0 SHEET | +1.8dB |
| (C) | 1 SHEET | 3 SHEETS | 3 SHEETS | 0 SHEET | +2.7dB |
| (D) | 1 SHEET | 3 SHEETS | 3 SHEETS | 2 SHEETS | +2.9dB |

FIG.8

ANTENNA DEVICE AND ELECTRONIC EQUIPMENT COMPRISING THE ANTENNA DEVICE

CROSS-REFERENCE TO RELATED APPLICATIONS

This application is based upon and claims the benefit of priority from prior Japanese Patent Applications No. 2005-354239, filed Dec. 8, 2005; and No. 2006-268049, filed Sep. 29, 2006, the entire contents of both of which are incorporated herein by reference.

BACKGROUND OF THE INVENTION

1. Field of the Invention

This invention relates to an antenna device and electronic equipment comprising the antenna device.

2. Description of the Related Art

As one type of electronic equipment, a radio wave clock is well known. The radio wave clock receives a standard radio wave including time information, and then, automatically corrects a current time. The radio wave clock uses a bar antenna device for receiving the standard radio wave, and the bar antenna device includes a core formed of a magnetic material such as an amorphous metal or ferrite and a coil wound around the core.

The radio wave clock is roughly classified into a wristwatch type and a placement clock type. An outer case of the wristwatch type radio wave clock is small, and thus, the antenna device is severe in dimensional restriction. In a case where the outer case of the wristwatch type radio wave clock is formed of a metal such as stainless or titanium, the metallic case lowers receiving sensitivity of the antenna device.

A structure for improving the receiving sensitivity of the antenna device is disclosed in FIGS. 1, 2, and 4 of Jpn. Pat. Appln. KOKAI Publication No. 2004-274609. In this conventional antenna device, a core is formed by laminating a plurality of sheet plates formed of a magnetic material such as an amorphous metal. A laminated core includes a coil winding portion around which a coil is wound, and a pair of coil non-winding portions which protrude from both ends of the coil winding portion and around which a coil is not wound. Spacers are inserted into the plurality of sheet plates at each of the coil non-winding portions to make the thickness of each of the coil non-winding portions being greater than that of the coil winding portion. However, a work of inserting the spacers into the plurality of sheet plates at each of the coil non-winding portions is complicated and increases manufacturing cost of this conventional antenna device. In addition, the antenna device that increases the thickness of each of the coil non-winding portions more greatly than that of the coil winding portion prevents the thickness of the outer case of the wristwatch type radio wave clock using such an antenna device from decreasing.

BRIEF SUMMARY OF THE INVENTION

An antenna device according to one aspect of the present invention is installed in a case of an electronic equipment, the case including a housing space for housing the antenna device and a surface in which an aperture is formed, the aperture allowing access from an external space to the housing space. The antenna device comprises a magnetic substance and a coil wound around the magnetic substance. The magnetic substance includes a coil winding portion, around which the coil is wound, and a pair of coil non-winding portions, which protrude from both ends of the coil winding portion, around each of which the coil is not wound, and which are magnetically coupled with the coil winding portion. And, at least one of the coil non-winding portions is curved in an arc shape toward a distal end thereof from a base thereof so as to extend along an inner peripheral surface of the housing space when the antenna device is housed in the housing space and is viewed from the surface of the case.

An electronic equipment according to one aspect of the present invention comprises: a case including a housing space and a surface in which an aperture is formed, the aperture allowing access from an external space to the housing space; the above described antenna device being housed in the housing space of the case; an electric circuit unit housed in the housing space of the case, electrically connected to the antenna device, and controlled on a basis of a signal inputted from the antenna device; and a decorative plate closing the aperture.

An electronic equipment according to another aspect of the present invention comprises: a case including a housing space and a surface in which an aperture is formed, the aperture allowing access from an external space to the housing space; the above described antenna device being housed in the housing space of the case; an electric circuit unit housed in the housing space of the case, electrically connected to the antenna device, and controlled on a basis of a signal inputted from the antenna device; and a decorative plate closing the aperture. The pair of coil non-winding portions of the magnetic substance comprises thin film shaped magnetic members provided on an inner surface of the decorative plate.

Additional objects and advantages of the invention will be set forth in the description of the which follows, and in part will be obvious from the description, or may be learned by practice of the invention. The objects and advantages of the invention may be realized and obtained by means of the instrumentalities and combinations particularly pointed out herein after.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 8 is a view showing a change of a receiving voltage generated when the first antenna device that can be used in the wristwatch of FIG. 1 receives a predetermined radio wave in a case where attaching positions and the number of foil elements of a magnetic substance are changed with respect to a pair of coil non-winding portions of the first antenna device;

DETAILED DESCRIPTION OF THE INVENTION

Figure 1:
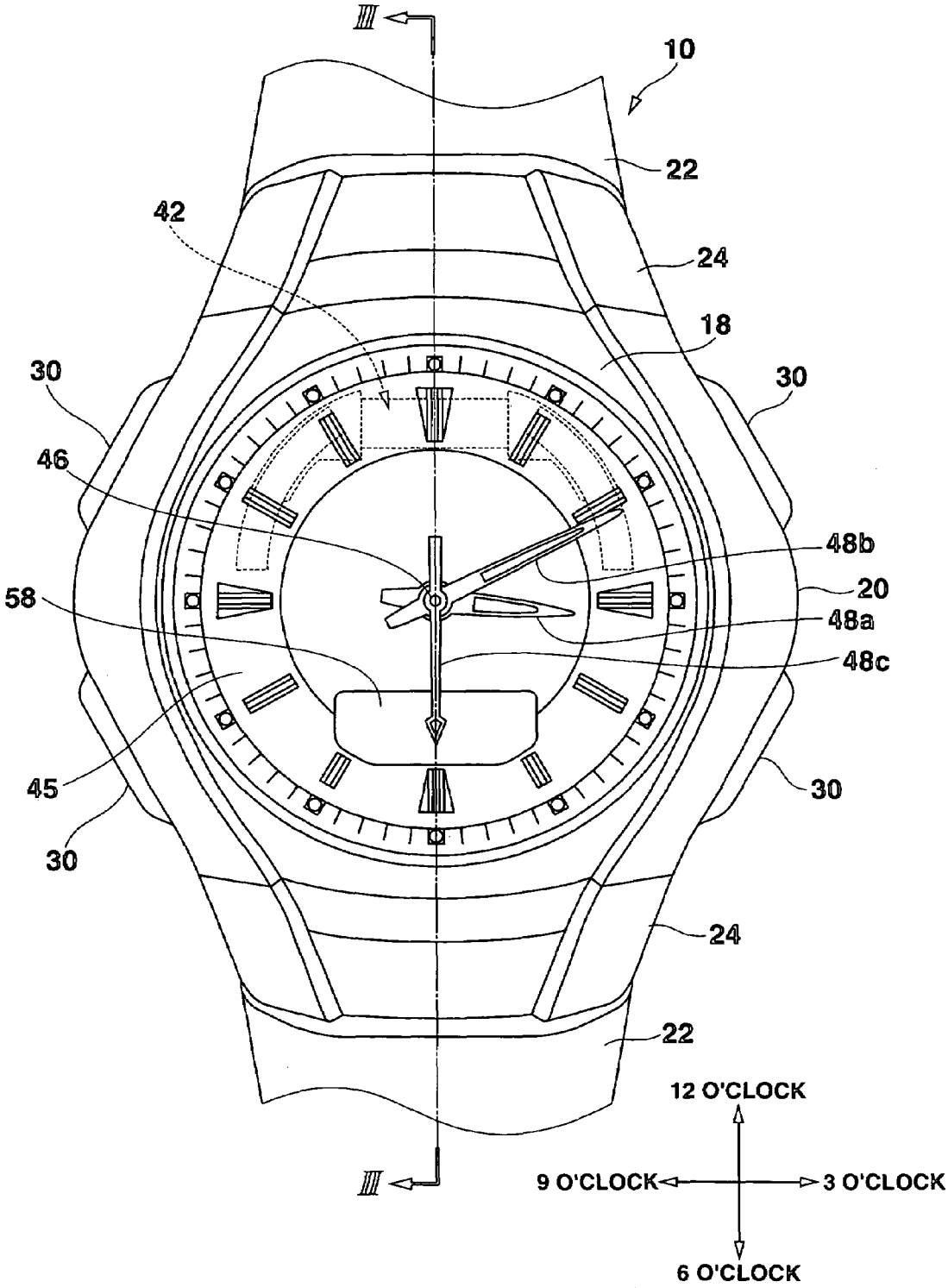
FIG. 1 is a plan view of a wristwatch according to an embodiment of the present invention.
Figure 2:
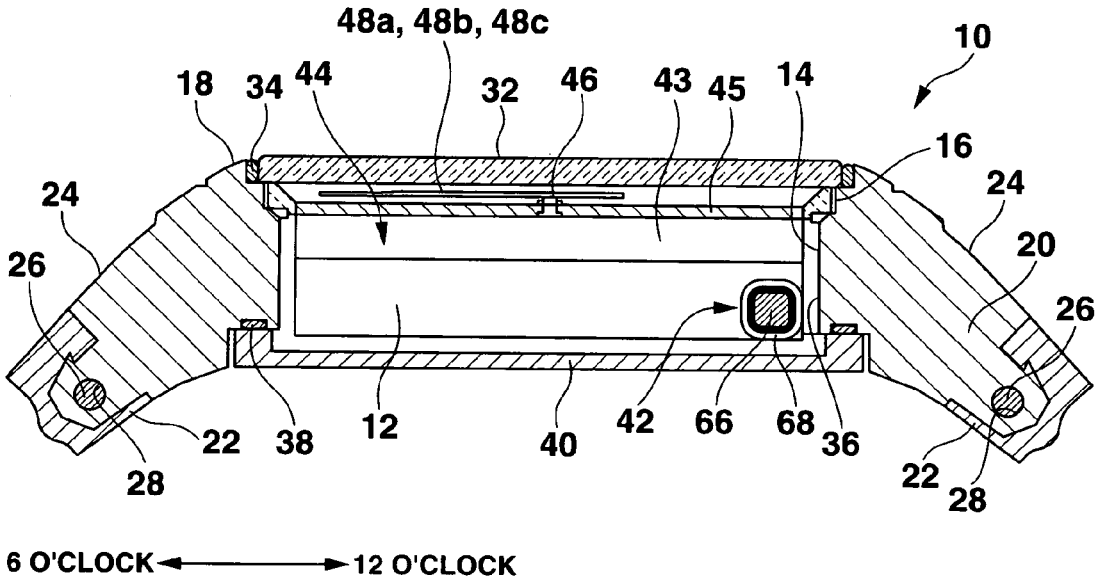
FIG. 2 is a sectional view taken along a line II-II in FIG. 1.

An electronic equipment 10 shown in FIGS. 1 and 2 and according to an embodiment of the present invention is a wristwatch. The electronic equipment 10 comprises a case 20 that includes a housing space 14 housing an electric circuit unit 12 and a surface 18 in which an aperture 16 is formed. The aperture 16 allows access from an external space to the housing space 14. The case 20 is formed of a metal material such as stainless or titanium, for example.

A pair of band attaching portions 24 are formed on two regions (a 12 o'clock direction region and a 6 o'clock direction region) that are fairly opposite to each other on an external periphery of the case 20, and both ends 22 of one watch band or proximal ends of a pair of watch bands are removably attached to the band attaching portions 24.

Each band attaching portion 24 protrudes outwardly from the external periphery of the case 20 in a radial direction of the case 20. An attaching hole 28 is formed at a protruding end portion of each of the band mounting portions 24, and a band attaching pin 26 inserted into each of the both ends 22 of the one watch band is removably attached in the attaching hole 28.

A plurality of switches 30 are mounted on the outer periphery of the case 20. The plurality of switches 30 are electrically connected to the electric circuit unit 12 in the housing space 14 of the case 20 so that an operation of the electric circuit unit 12 is controlled by operating each of the switches 30. That is, any of a plurality of functions preset in the electric circuit unit 12 can be performed.

A watch glass 32 is mounted on the surface 18 of the case 20 via a packing 34 and covers the aperture 16. In the present embodiment, a back aperture 36 is formed in a back surface of the case 20, and the back aperture 36 allows access from an external space to the housing space 14. The back aperture 36 is covered with a back cap 40 via a packing 38. The back cap 40 is formed of a metal such as stainless or titanium, for example.

An antenna device 42, a battery serving as a drive source for the electric circuit unit 12, and a well known analog hand moving mechanism 43 are also housed in the housing space 14 of the case 20, and an operation of the analog hand moving mechanism 43 is controlled by the electric circuit unit 12. The antenna device 42, the battery, and the analog hand moving mechanism 43, together with the electric circuit unit 12, configure a watch module 44.

The antenna device 42 is electrically connected to the electric circuit unit 12, and an operation of the electric circuit unit 12 is controlled on a basis of a signal received by the antenna device 42.

A decorative plate 45 closes the aperture 16 of the surface 18 of the case 20 between the watch glass 32 and the watch module 44. In the present embodiment, the decorative plate 45 is configured as a dial plate, and the analog hand moving mechanism 43 includes three concentrically arranged indicator shafts 46 penetrating the decorative plate 45. An hour hand 48*a*, a minutes hand 48*b*, and a second hand 48*c* are attached on the distal ends of the three indicator shafts 46.

Figure 3:
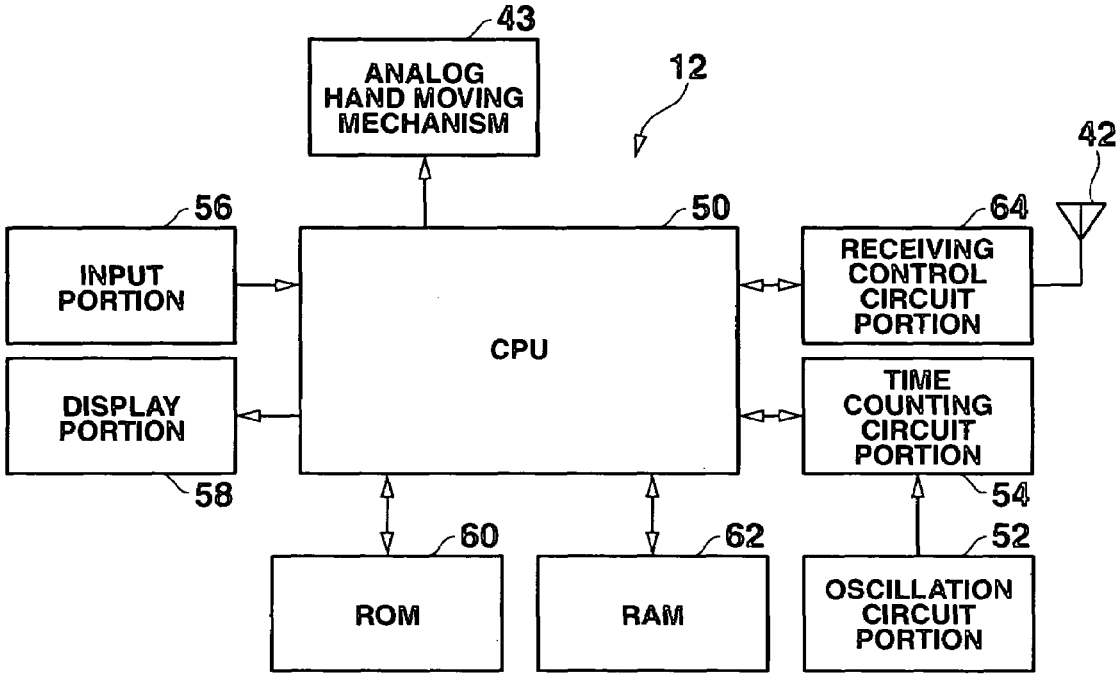
FIG. 3 is a schematic block diagram of an electric circuit unit used in the wristwatch of FIG. 1.

FIG. 3 shows a schematic structure of the electric circuit unit 12 is shown by blocks.

The electric circuit unit 12 includes a control IC 50 like a central processing unit (CPU), an oscillation circuit portion 52, a time counting circuit portion 54 connected to the oscillation circuit portion 52, an input portion 56, a display portion 58, a ROM 60, a RAM 62, and a receiving control circuit portion 64 electrically connected to the antenna device 42. And, the time counting circuit portion 54, the input portion 56, the display portion 58; the ROM 60, the RAM 62, and the receiving control circuit portion 64 are electrically connected to the CPU 50.

The oscillation circuit portion 52 always outputs a clock signal of a predetermined frequency. The time counting circuit portion 54 calculates a current time based on the clock signal outputted from the oscillation circuit portion 52, and then outputs current time data to the CPU 50. The input portion 56 includes the plurality of switches 30. The display portion 58 includes a screen exposed in a part of the decorative plate 44. The ROM 60 stores a plurality of system programs, application programs, or data and the like, relating to an operation of the electronic equipment 10. The RAM 62 is used as a work area of the CPU 50, and temporarily stores the programs or data read out from the ROM 60 and the data or the like processed by the CPU 50. The receiving control circuit portion 64 cuts an unnecessary frequency component from a standard time signal received by the antenna device 42 to take out a predetermined frequency signal (time code of standard time), then converts the predetermined frequency signal into a corresponding electronic signal, and output the converted electrical signal to the CPU 50.

A not shown motor serving as a drive source for the analog hand moving mechanism 43 is further electrically connected to the CPU 50.

The CPU 50 reads out any of the plurality of programs stored in the ROM 400 in response to a predetermined timing or an operating signal inputted from any switch 30 of the input portion 56, expands the read out program on the RAM 500, and carries out commanding, data transfer and the like to the analog hand moving mechanism 43, the display portion 58, the time counting circuit portion 54, and the receiving control circuit portion 54, based on the read out program. Specifically, the CPU 50 controls the receiving control circuit portion 64 at every predetermined times, for example, and makes the receiving control circuit portion 64 receive the standard time radio wave including the time code of the standard time via the antenna device 42. Then, the CPU 50 corrects the current time data calculated by the time counting circuit portion 54 based on this receiving signal, makes the analog hand moving mechanism 43 indicate the current time calculated and corrected by the time counting circuit portion 54, and further makes the display portion 58 display the current time.

Now, a configuration of the antenna device 42 will be described with reference to FIGS. 4A and 4B. The antenna device 42 comprises a magnetic substance 66 and a coil 68 wound around the magnetic substance 66. The magnetic substance 66 includes a coil winding portion 70 around which the coil 68 is wound and a pair of coil non-winding portions 72 which protrude from both ends of the coil winding portion 70 and which are magnetically coupled to the coil winding portion 70. The coil 68 is not wound around each of the coil non-winding portions 72.

At least one, each of the both in this embodiment, of the pair of coil non-winding portions 72 is curved in an arc shape from a base thereof to a distal end thereof so as to extend along an internal periphery of the housing space 14 of the case 20.

The magnetic substance 66 includes a core member that contains the coil winding portion 70 and the pair of coil non-winding portions 72, and the core member is a laminated core member structured by laminating a plurality of sheet plates of magnetic material like an amorphous metal one another. The plurality of sheet plates of the laminated core member are classified into two types of groups, one of which is a short piece 74 and another of which is a long piece 76 that is longer than the short piece 74.

Both end portions of the short piece 74 correspond to the pair of coil non-winding portions 72 and a center portion of the short piece 74 corresponds to the coil winding portion 70, as viewed from the surface 18 of the case 20. The width of each of the both end portions of the short piece 74 is so set that it is larger than that of the center portion thereof. A side edge of each of the both end portions, facing the inner periphery of the housing space 14 of the case 20, is curved along the inner periphery.

Both end portions of the long piece 76 also correspond to the pair of coil non-winding portions 72 and a center portion of the long piece 76 also corresponds to the coil winding portion 70, as viewed from the surface 18 of the case 20. The width of each of the both end portions of the long piece 74 is so set that it is the same as that of the center portion thereof. Each of the both end portions of the long piece 76 is curved along the inner periphery of the housing space 14 of the case 20.

In the laminated core member of the magnetic substance 66, a first group including the plurality of laminated short pieces 74 is located near to the back cap 40 and a second group including the plurality of laminated long pieces 76 is located near to the decorative plate 45. With this location, a length of each one of the groups decreases in a stepwise manner from the second group (the laminated long pieces 76) that is the closest to the surface 18 of the case 20 to the first group (the laminated short pieces 74) that is the most distant from the surface 18 of the case 20, in the laminated core member of the magnetic substance 66 along a depth direction D of the housing space 14.

In addition, as viewed from the surface 18 of the case 20, in each of the coil non-winding portions 72 of the laminated core member of the magnetic substance 66, a width of a distal end region of each of the coil non-winding portions 72, which is distant from each of the both ends of the coil winding portion 70, (a width of a distal end region of each of the both end portions of the laminated long pieces 76 of the second group in the present embodiment) is smaller than that of a base region of each of the coil non-winding portions 72, which is close to each of the both ends of the coil winding portion 70, (a width of a combination of a base region of each of the both end portions of the laminated long pieces 76 of the second group and each of the both end portions of the laminated short pieces 74 of the first group in the present embodiment).

Further, in each of the coil non-winding portions 72 of the laminated core member of the magnetic substance 66, a dimension taken along a depth direction D of the housing space 14 in the distal end region of each of the coil non-winding portions 72, which is distant from each of the both ends of the coil winding portion 70, (a dimension taken along the depth direction D of the housing space 14 in a distal end region of each of the both end portions of the laminated long pieces 76 of the second group in the present embodiment) is smaller than that of a base region of each of the coil non-winding portions 72, which is close to each of the both ends of the coil winding portion 70, (a dimension taken along the depth direction D of the housing space 14 in a combination of a base region of each of the both end portions of the laminated long pieces 76 of the second group and each of the both end portions of the laminated short pieces 74 of the first group in the present embodiment).

The laminated core member of the magnetic substance 66 is housed in a core case 78 of synthetic resin. The core case 78 includes a main body 78*a* and a cover 78*b*. The main body 78*a* has an opening to expose a surface of the laminated core member, which is the closest to the surface 18 of the case 20, and the cover 78*b* covers the aperture of the main body 78*a*.

A pair of outward flanges 78*c* are formed at longitudinal both ends of a portion on an outer surface of the core case 78, the portion corresponding to the center portion of the laminated core member, and a lead wire is wound on the portion of the outer surface of the core case 78 between the outer flanges 78*c* and configures a coil 68.

The pair of coil non-winding portions 72 of the laminated core member of the magnetic substance 66 includes a pair of foil elements 80 each of which protrudes in an outer direction from each of the both ends of the coil winding portion 70 of the laminated core member. Each foil element 80 is formed of a material having a magnetic permeability that is smaller than that of the laminated core member of the magnetic substance 66. In the present embodiment, the foil member is formed of an amorphous metal having a thickness of 16 μm.

The foil elements 80 are magnetically coupled to the both ends of the coil winding portion 70 of the laminated core member. The term "magnetically coupled" used here includes a case in which one magnetic member (the foil 80 in the present embodiment) and the other magnetic member (the coil winding portion 70 of the laminated core member in the present embodiment) are directly connected to each other so that magnetism passes through these magnetic members, of course, and a case in which one magnetic member (the foil 80 in the present embodiment) and the other magnetic member (the coil winding portion 70 of the laminated core member in the present embodiment) are faced each other with a gap therebetween so that magnetism passes through these magnetic members via the gap.

In the present embodiment, the foil elements 80 are adhered by adhesive onto outer surfaces of longitudinal both end portions of the core case 78, corresponding to the coil non-winding portions 72 of the laminated core member of the magnetic substance 66. More specifically, the foil elements 80 are adhered to outer surfaces of longitudinal both end portions of the cover 78*b* of the core case 78, and extend along the extending directions of the coil non-winding portions 72.

When the antenna device 42 is placed in a magnetic field of a standard time radio wave (hereinafter, referred to as a "signal magnetic field"), the signal magnetic filed acts to the antenna device 42 as follows. The standard time radio wave is a long wave having a wavelength of several kilometers, and the magnetic field may be regarded as a parallel magnetic field in which magnitude of each component of the magnetic field does not change at arbitrary location in the dimensional range of the antenna device 42.

When the magnetic substance 66 is placed in the signal magnetic field to arrange a center line of the coil 68 in parallel to the direction of the signal magnetic field, a magnetic flux of the signal magnetic field (hereinafter, referred to as a "signal magnetic flux") concentrates at the magnetic substance 66 having magnetic permeability higher than that of an space surrounding the magnetic substance 66. As a result, the signal magnetic flux and the coil 68 cross each other, and an inductive electromotive force V is generated in the coil 68 such that a magnetic flux is generated in a direction that can prevent a change of the signal magnetic flux inside the coil 68 in accordance with a Lenz's law. And, since the signal magnetic field as an alternating magnetic field cyclically changes magnitude and direction of the signal magnetic flux, the inductive electromotive force V is an alternative electric force. As a result, at the magnetic substance 66 as well, an alternative magnetic field is generated such that the size or direction of the magnetic flux cyclically changes in accordance with a time based change of the signal magnetic flux.

The inductive electromotive force V generated in the coil 68 is detected by the receiving control circuit portion 64 (refer to FIG. 3) connected to the coil 68. The receiving control circuit portion 64 includes a tuning condenser and loss resistor for tuning at a frequency of the standard time radio wave to be received (40 kHz or 60 kHz in Japan).

In general, a magnetic flux is distributed so that a magnetic resistance becomes as small as possible. Therefore, the signal magnetic flux passes through the pair of foil elements 80 each having higher magnetic permeability than air, or alternatively, is attracted to the foil elements 80. Further, the signal magnetic flux is attracted to the laminated core member having higher magnetic permeability than that of each foil element 80, and passes through the laminated core member. Namely, in a case where the pair of foil elements 80 are provided at both ends of the coil winding portion 70 of the laminated core member, more signal magnetic fluxes pass through the laminated core member as compared with a case in which the pair of foil elements 80 are not provided. As a result, the inductive electromotive force V generated in the coil 68 increases, and the receiving sensitivity of the antenna device 42 is improved.

In addition, where the pair of foil elements 80 are provided at the both ends of the coil winding portion 70 of the laminated core member, the signal magnetic flux can flow in the laminated core member more easily. Thus, the effective magnetic permeability of the magnetic substance 66 rises, and its resonance frequency is lowered. This is because an inductance L is increased by rise of the effective magnetic permeability.

$$f=1/2\Pi(LC)1/2 \qquad \text{(Formula 1)}$$

As shown in (formula 1), a resonance frequency f is reduced as the inductance L increases.

Figure 4A:
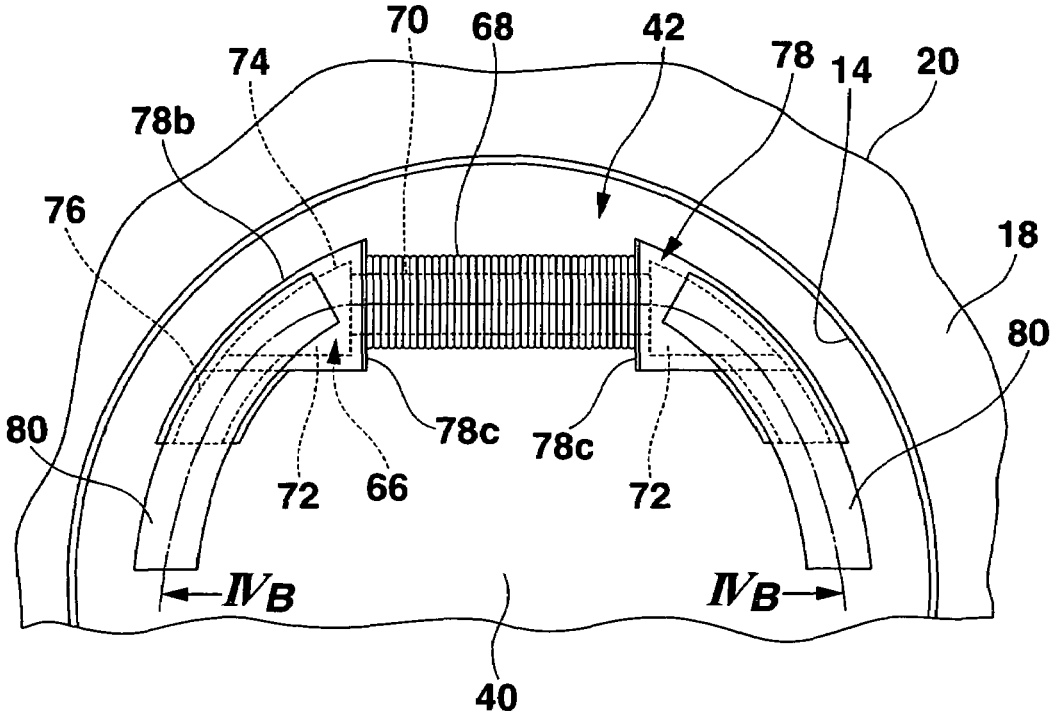
FIG. 4A is an enlarged plan view of a first antenna device used in the wristwatch of FIG. 1.
Figure 4B:
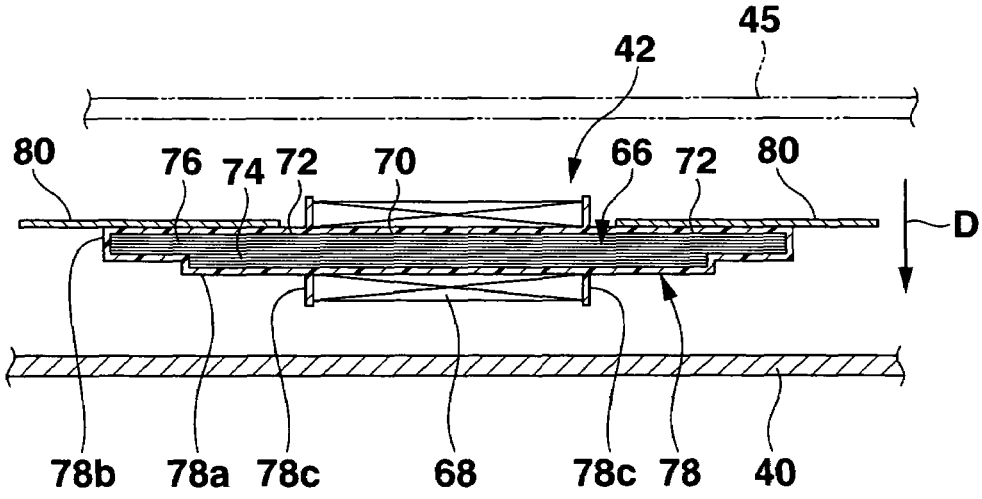
FIG. 4B is a sectional view taken along a line IVB-IVB in FIG. 4A.

As shown in FIGS. 4A and 4B, the antenna device 42 is located at a position of 12 o'clock in the housing space 14 of the case 20*a* to close to the inner periphery of the housing space 14. Further, the pair of coil non-winding portions 72 located at the longitudinal both ends of the magnetic substance 66 extend along the inner periphery of the housing space 14. Therefore, the antenna device 42 can be located at the position of 12 o'clock in the housing space 14 of the case 20*a* as close as possible to the inner periphery of the housing space 14. Further, the pair of foil elements 80 are adhered onto the outer surface of the cover 78*b* of the core case 78 and extend along the inner periphery of the housing space 14 and further extend along the inner surface of the decorative plate 45 in the aperture 16 of the housing space 14 of the case 20. Therefore, since the antenna device 42 occupies only a small volume in the housing space 14, a dead space along the inner periphery of the housing space 14 in the housing space 14 can be used to house the antenna device 42, and the depth of the housing space 14 can be reduced. In addition, although the antenna device 42 is located in the housing space 14 of the metallic case 20, the antenna device 42 can efficiently receive the standard time signal that incident into the housing space 14 via the aperture 16 of the housing space 14.

[First Modification of the Antenna Device 42]

Figure 5A:
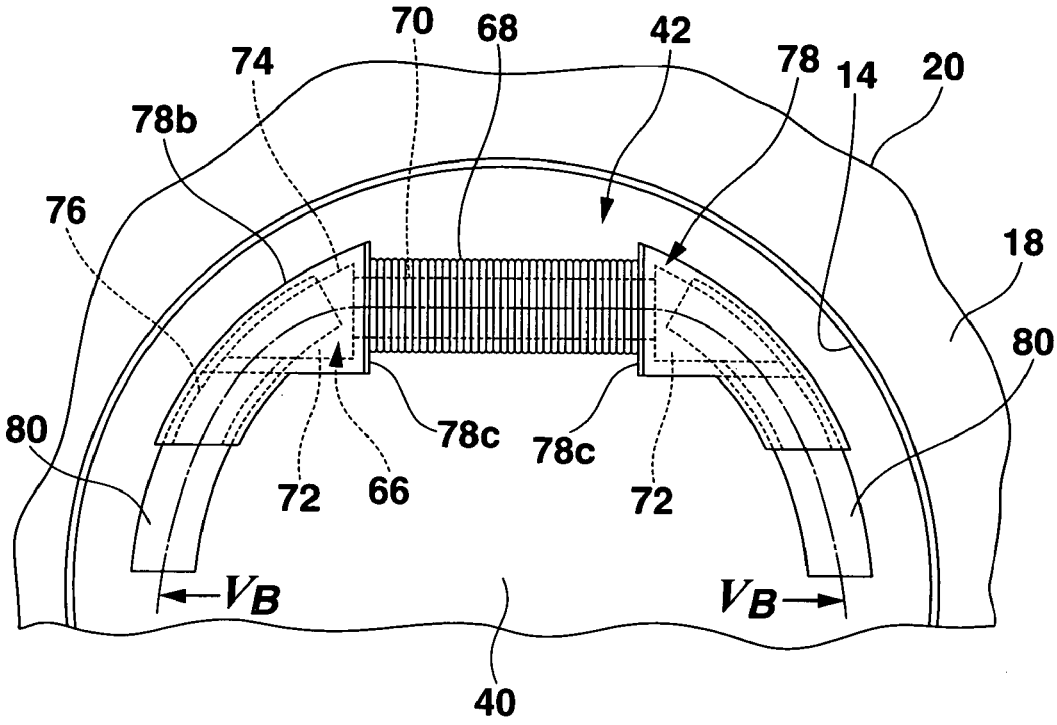
FIG. 5A is an enlarged plan view of a first modification of the first antenna device, which can be used in the wristwatch of FIG. 1.
Figure 5B:
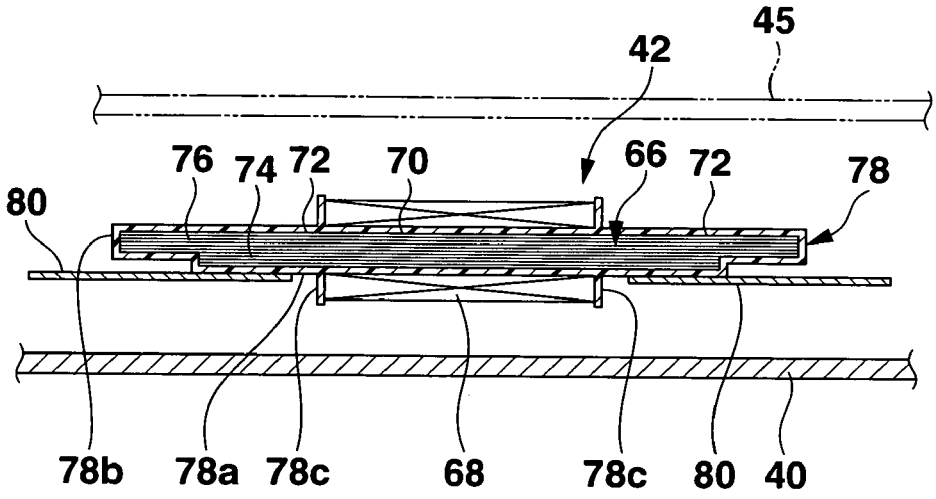
FIG. 5B is a sectional view taken along a line VB-VB of FIG. 5A.

FIGS. 5A and 5B show a first modification of the antenna device 42 (first antenna device) described above with reference to FIGS. 4A and 4B.

Structural members of the first modification of the antenna device 42 are the same as those of the antenna device 42. Therefore, in the first modification shown in FIGS. 5A and 5B, the same structural members as those of the antenna device 42 shown in FIGS. 4A and 4B are designated by the same reference numerals as those designating those of the antenna device 42. Detailed descriptions thereof are omitted here.

The first modification is different from the antenna device 42 in that the pair of foil elements 80 are adhered to regions on the outer surfaces of the longitudinal both end portions of the main body 78*a* of the core case 78, the regions corresponding to the longitudinal both end portions of the plurality of short pieces 74 of the first group in the laminated core member of the magnetic substance 66 and facing the back cover 40, and the pair of foil elements 80 extend along the extending directions of the pair of coil non-winding portions 72 of the laminated core member of the magnetic substance 66.

[Second Modification of the Antenna Device 42]

Figure 6A:
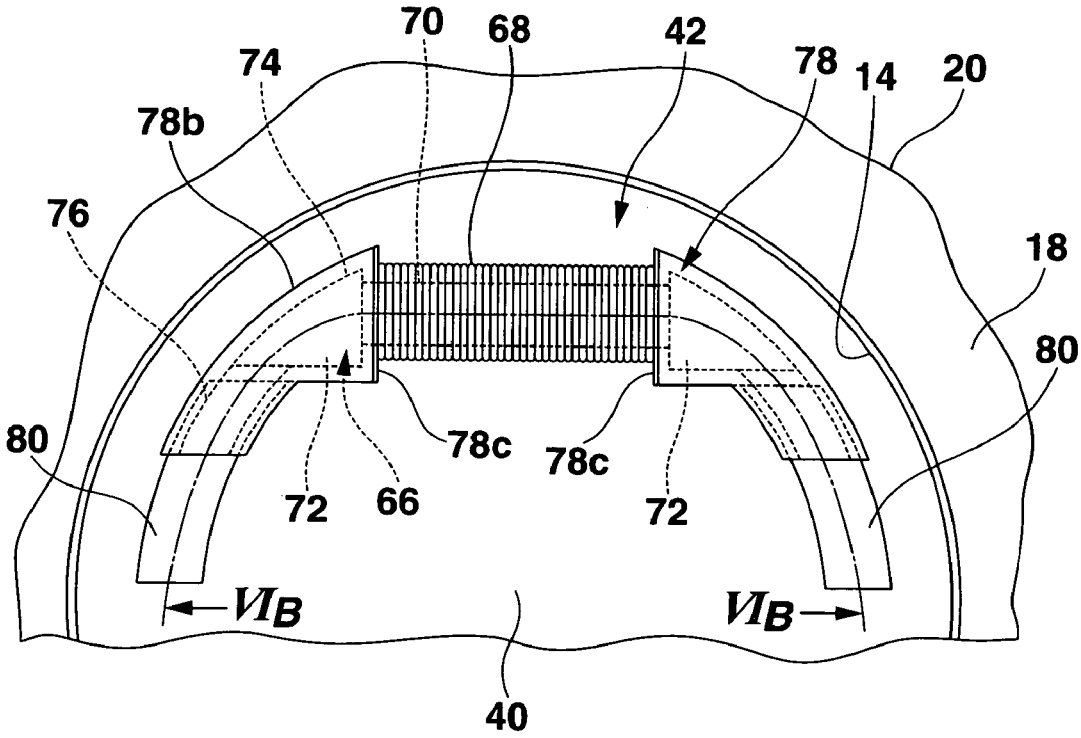
FIG. 6A is an enlarged plan view of a second modification of the first antenna device, which can be used in the wristwatch of FIG. 1.
Figure 6B:
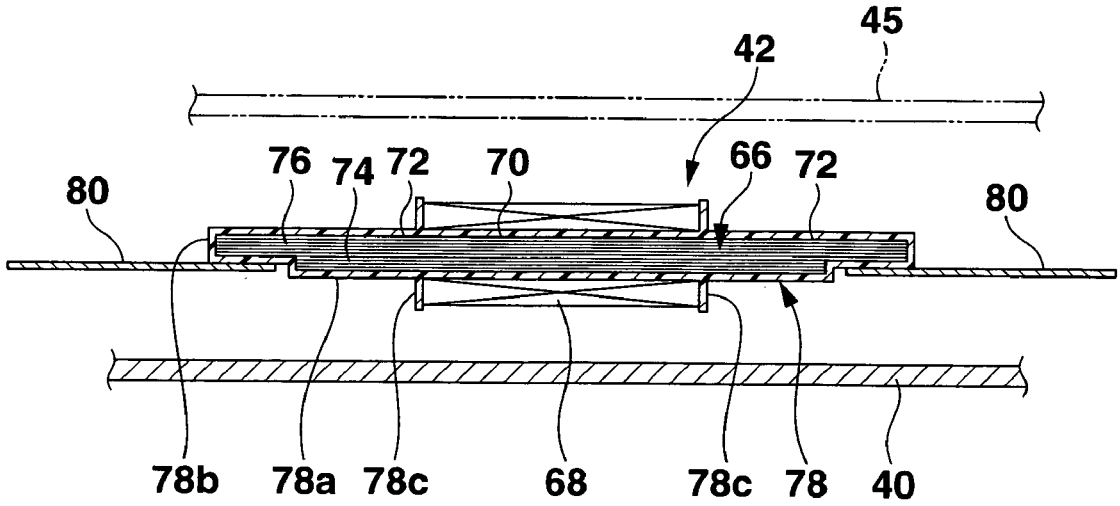
FIG. 6B is a sectional view taken along a line VIB-VIB in FIG. 6A.

FIGS. 6A and 6B show a second modification of the antenna device 42 (first antenna device) described above with reference to FIGS. 4A and 4B.

Structural members of the second modification of the antenna device 42 are the same as those of the antenna device 42. Therefore, in the second modification shown in FIGS. 6A and 6B, the same structural members as those of the antenna device 42 shown in FIGS. 4A and 4B are designated by the same reference numerals as those designating those of the antenna device 42. Detailed descriptions thereof are omitted here.

The second modification is different from the antenna device 42 in that the pair of foil elements 80 are adhered to regions on the outer surfaces of the longitudinal both end portions of the main body 78*a* of the core case 78, the regions corresponding to the longitudinal both end portions of the plurality of long pieces 76 of the second group in the laminated core member of the magnetic substance 66 and facing the back cover 40, and the pair of foil elements 80 extend along the extending directions of the pair of coil non-winding portions 72 of the laminated core member of the magnetic substance 66.

[Third Modification of the Antenna Device 42]

Figure 7A:
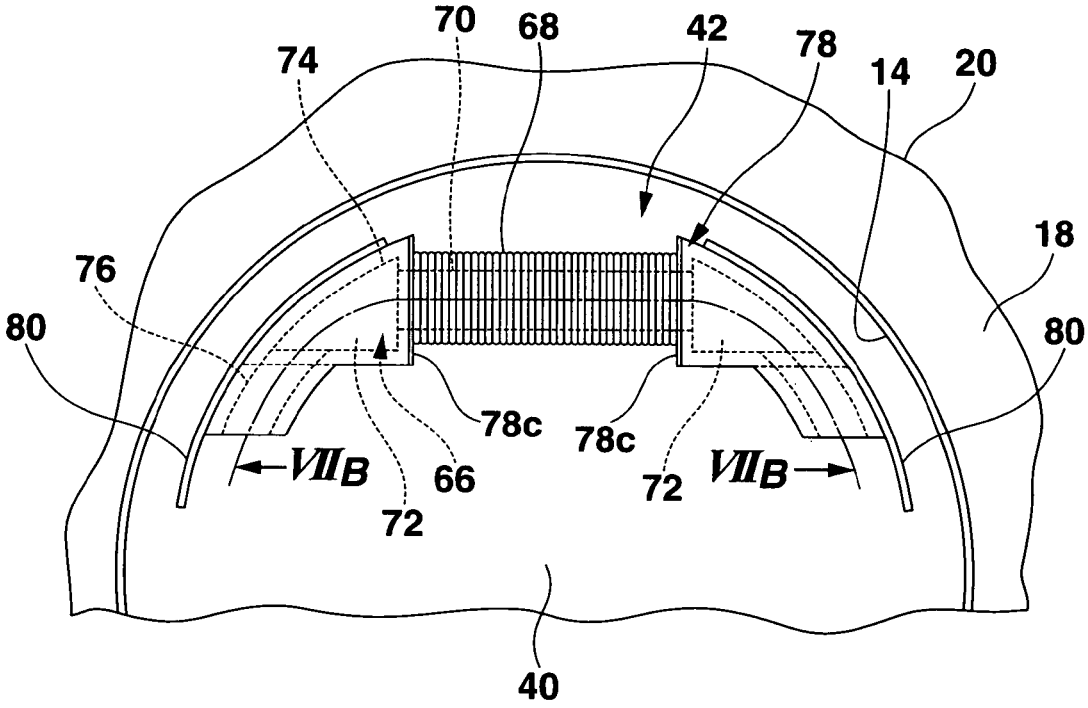
FIG. 7A is an enlarged plan view of a third modification of the first antenna device, which can be used in the wristwatch of FIG. 1.
Figure 7B:
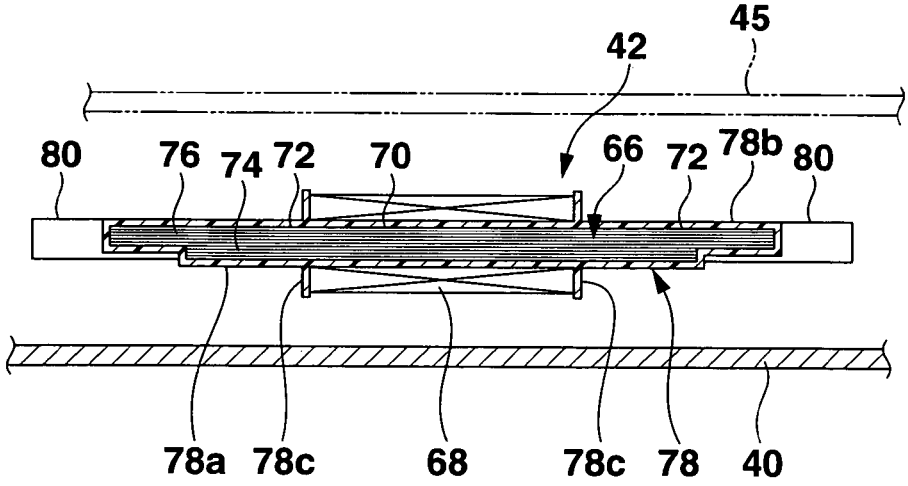
FIG. 7B is a sectional view taken along a line VIIB-VIIB in FIG. 7A.

FIGS. 7A and 7B show a third modification of the antenna device 42 (first antenna device) described above with reference to FIGS. 4A and 4B.

Structural members of the third modification of the antenna device 42 are the same as those of the antenna device 42. Therefore, in the third modification shown in FIGS. 7A and 7B, the same structural members as those of the antenna device 42 shown in FIGS. 4A and 4B are designated by the same reference numerals as those designating those of the antenna device 42. Detailed descriptions thereof are omitted here.

The third modification is different from the antenna device 42 in that the pair of foil elements 80 are adhered to regions on the outer surfaces of the longitudinal both end portions of the main body 78*a* of the core case 78, the regions facing the inner periphery of the housing space 14, and the pair of foil elements 80 extend along the extending directions of the pair of coil non-winding portions 72 of the laminated core member of the magnetic substance 66.

[Relationship Between Attaching Positions and the Number of the Foil Elements 80 Attached and Receiving Performance in the Antenna Device 42]

FIG. 8 shows measurement results which are obtained by comparing receiving sensitivity of the antenna device 42 in four cases (A) to (D) with receiving sensitivity of an antenna device having the same configuration as that of the antenna device 42, expecting that the foil elements 80 are not attached thereto, when each of these antenna devices is placed at a location being away from a transmitter in a predetermined distance and each antenna device receives a radio wave corresponding to the standard time radio wave and transmitted from the transmitter. In four cases (A) to (D), attaching positions and the number of the foil elements 80 on each of the longitudinal both end portions of the outer surface of the core case 78 for the antenna device 42.

In the case (A), as shown in FIGS. 6A and 6B, one foil element 80 is adhered on each of the pair of regions on the outer surface of the both longitudinal end portions of the main body 78*a* of the core case 78, the pair of regions corresponding to the both longitudinal end portions of the plurality of long pieces 76 of the second group of the laminated core members of the magnetic substance 66 and facing the back cover 40, and each of the pair of foil elements 80 extends along the extending direction of each of the pair of coil non-winding portions 72 of the laminated core member of the magnetic substance 66.

In the case (B), three foil elements 80, instead of one, are adhered to each of the same regions on the outer surface of the both longitudinal end portions of the main body 78*a* of the core case 78 in the case (A).

In the case (C): as shown in FIGS. 5A and 5B, one foil element 80 is adhered to each of the pair of regions on the outer surface of the both longitudinal end portions of the main body 78*a* of the core case 78, the pair of regions corresponding to the both longitudinal end portions of the plurality of short pieces 74 of the first group of the laminated core members of the magnetic substance 66 and facing the back cover 40, and each of the pair of foil elements 80 extends along the extending direction of each of the pair of coil non-winding portions 72 of the laminated core member of the magnetic substance 66; as in the case (B), three foil elements 80, instead of one, are adhered to each of the same regions on the outer surface of the both longitudinal end portions of the main body 78*a* of the core case 78 in the case (A); and, three foil elements 80, instead of one, are adhered to each of the both longitudinal end portions on the outer surface of the cover 78*b* of the core case 78 as shown in FIGS. 4A and 4B, and the three foil elements 80 are extended along the inner periphery of the housing space 14 and are extended along the inner surface of the decorative plate 45 in the aperture 16 of the case 20.

In the case (D), in addition to the case (C), two foil elements 80, instead of one, are adhered to each of the same regions on the outer surface of the both longitudinal end portions of the main body 78*a* of the core case 78 as shown in FIGS. 7A and 7B, and the two foil elements 80 are extended along the extending direction of each of the pair of coil non-winding portions 72 of the laminated core member of the magnetic substance 66.

In any of the cases (A) to (D), a receiving voltage rises as compared with the case in which the foil elements 80 are not adhered. That is, the receiving sensitivity of the antenna device 42 having at least a pair of foil elements 80 magnetically coupled with the both ends of the laminated core member of the magnetic substance 66 is improved in comparison with that of the antenna device having the same configuration as the antenna device 42, excepting that the foil elements 80 are not magnetically coupled.

In comparison between the case (A) and the case (B), the rise of the receiving voltage in the case (B) is more remarkable than that in the case (A). In comparison between the case (B) and the case (C), the rise of the receiving voltage in the case (C) is more remarkable that that in the case (B). Further, in comparison between the case (C) and the case (D), the rise of the receiving voltage in the case (D) is more remarkable than that in the case (C).

That is, the receiving sensitivity of the antenna device 42 can be improved by increasing the number of foil elements 80 to be adhered and the number of positions to which the foil elements 80 are to be adhered.

[Second Antenna Device]

Figure 9A:
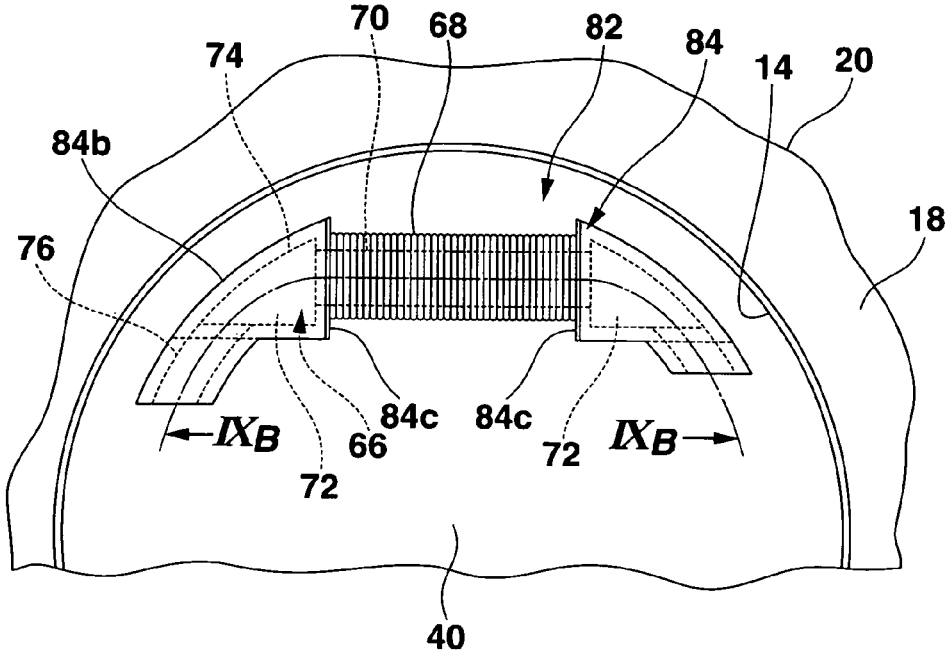
FIG. 9A is an enlarged plan view of a second antenna device that can be used in the wristwatch of FIG. 1.
Figure 9B:
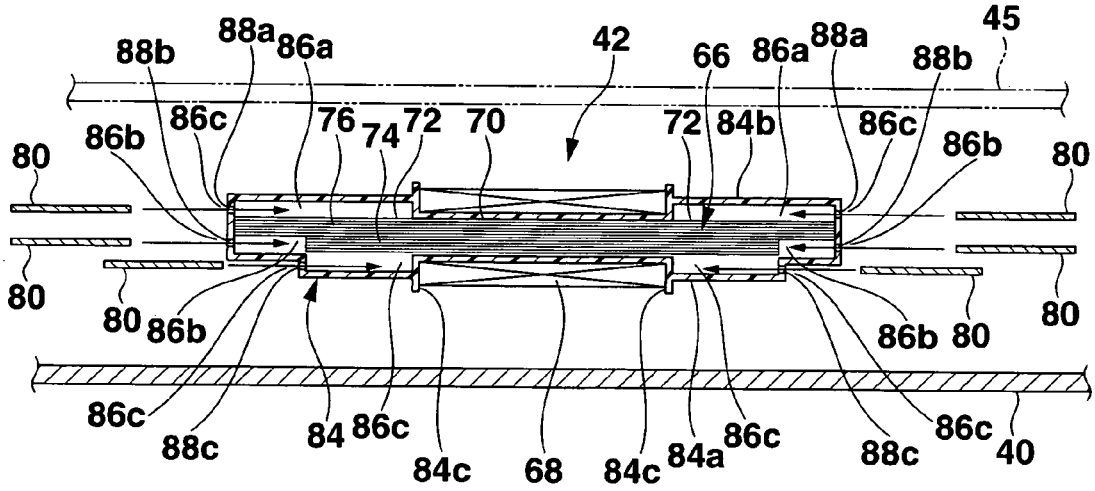
FIG. 9B is a schematic cross sectional view taken along a line IX-IX in FIG. 9A, wherein a plurality of foil elements of a magnetic substance are separated from each of a pair of coil non-winding portions of the magnetic substance of the second antenna device.

Now, a second antenna device 82 that can be used in the electronic equipment 10 shown in FIGS. 1 and 2 is described with reference to FIGS. 9A and 9B.

Structural members of the second antenna device 82 are the same as those of the first antenna device 42 described above with reference to FIGS. 4A and 4B. Therefore, in the second antenna device 82, the same structural members as those of the first antenna device 42 are designated by the same reference numerals as those designating those of the first antenna device 42. Detailed descriptions thereof are omitted here.

The second antenna device 82 is different from the first antenna device 42 in a structure of a core case 84 for housing the laminated core member of the magnetic substance 66.

The core case 84 is formed of a synthetic resin, and includes a main body 84*a* and a cover 84*b*. The main body 84*a* houses the laminated core member and has an aperture exposing a surface of the laminated core member, the surface being the closest to the surface 18 of the case 20, and the cover 84*b* closes the aperture.

A pair of outward flanges 84*a* are formed at both longitudinal ends of a portion on the outer surface of the core case 84, the portion corresponding to the center portion of the laminated core member, and a lead wire is wound on the center portion of the outer surface of the core case 84 between the pair of outward flanges 84*c*, thereby configuring a coil 68.

Each portion of the core case 84, which houses each of the both end portions of the laminated core member, i.e., each of the pair of coil non-winding portions 72 of the magnetic substance 66, produces a first gap 86*a* to a region at each of the both longitudinal end portions of the plurality of long pieces 76 in the second group of the laminated core members, that region facing the decorative plate 45. The above described each portion of the core case 84 also produces a second gap 86*b* to a region at each of the both longitudinal end portions of the plurality of long pieces 76 in the second group of the laminated core members, that region facing the back cover 40. The above described each portion of the core case 84 further produces a third gap 86*c* to a region at each of the both longitudinal end portions of the plurality of short pieces 74 in the first group of the laminated core members, that region facing the back cover 40.

Further, slits 88*a*, 88*b*, and 88*c* are formed at positions on each of the both longitudinal end portions of the core case 84, the positions corresponding to the first gap 86*a*, the second gap 86*b*, and the third gap 86*c*. These slits 88*a*, 88*b*, and 88*c* allow access to the first gap 86*a*, the second gap 86*b*, and the third gap 86*c* from an external space.

Foil elements 80 are inserted into the first gap 86*a*, the second gap 86*b*, and the third gap 86*c* at each of the both longitudinal end portions of the core case 84 through these slits 88*a*, 88*b*, and 88*c*.

The foil element 80 inserted into the first gap 86*a* is magnetically connected to the region of each of the both longitudinal end portions of the plurality of long pieces 76 in the second group of the laminated core members in the core case 84, the region facing the decorative plate 45.

The foil element 80 inserted into the second gap 86*b* is magnetically connected to the region of each of the both longitudinal end portions of the plurality of long pieces 76 in the second group of the laminated core members in the core case 84, the region facing the back cover 40.

The foil element 80 inserted into the third gap 86*c* is magnetically connected to the region of each of the both longitudinal end portions of the plurality of short pieces 74 in the first group of the laminated core members in the core case 84, the region facing the back cover 40.

The number of foil elements 80 inserted into each of the first gap 86*a*, the second gap 86*b*, and the third gap 86*c* through each of the slits 88*a*, 88*b*, and 88*c* can be set in a range between one and plural in relation to the thickness of the foil element 80, the height of each of the slits 88*a*, 88*b*, and 88*c*, and the height of each of the first gap 86*a*, the second gap 86*b*, and the third gap 86*c*.

[Third Antenna Device]

Figure 10A:
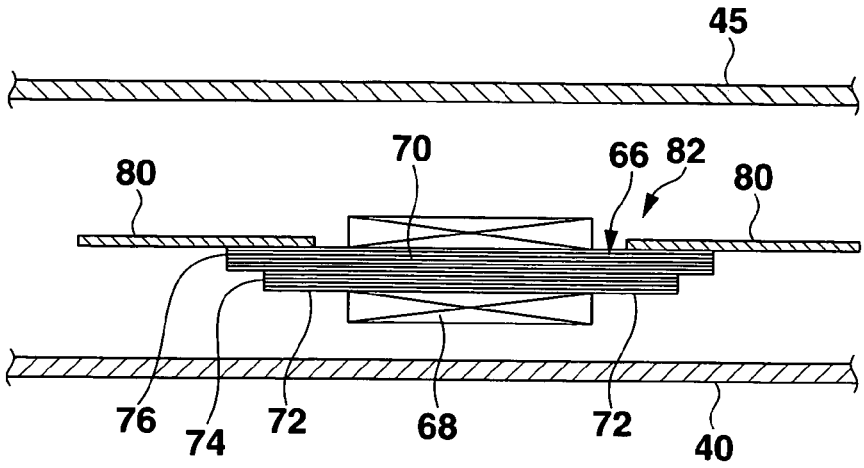
FIG. 10A is an enlarged sectional view of a third antenna device that can be used in the wristwatch of FIG. 1.

Now, a third antenna device 92 that can be used in the electronic equipment 10 shown in FIGS. 1 and 2 is described with reference to FIG. 10A.

Structural members of the third antenna device 92 are the same as those of the first antenna device 42 described above with reference to FIGS. 4A and 4B. Therefore, in the third antenna device 92, the same structural members as those of the first antenna device 42 are designated by the same reference numerals as those designating those of the first antenna device 42. Detailed descriptions thereof are omitted here.

The third antenna device 92 is different from the first antenna device 42 in that the core case 78 is omitted. The coil 68 is wound around the outer surface of the coil winding portion 70 at the center portion of the laminated core member of the magnetic substance 66. And, a pair of foil elements 80 is adhered to a pair of regions on the pair of coil non-winding portions 72 at the both longitudinal end portions of the laminated core member of the magnetic substance, the regions facing the decorative plate 45. That is, the pair of foil elements 80 is adhered to a pair of regions on the both longitudinal end portions of the plurality of long pieces 76 of the second group in the laminated core member, the regions facing the decorative plate 45. The pair of foil elements 80 extend along the extending directions of the pair of coil non-winding portions 72.

[First to Third Modifications of the Third Antenna Device 92]

Now, first to third modifications of the third antenna device 92, each of which can be used in the electronic equipment 10 shown in FIGS. 1 and 2, will be described with reference to FIGS. 10B and 10C.

Structural members of each of the first to third modifications of the third antenna device 92 are the same as those of the first antenna device 42 described above with reference to FIGS. 4A and 4B. Therefore, in each of the first to third modifications of the third antenna device 92, the same structural members as those of the first antenna device 42 are designated by the same reference numerals as those designating those of the first antenna device 42. Detailed descriptions thereof are omitted here.

Figure 10B:
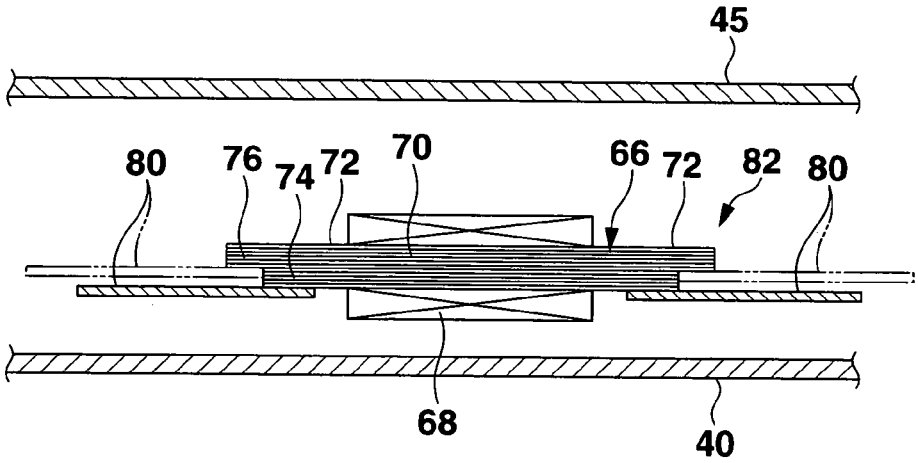
FIG. 10B is an enlarged sectional view of first and second modifications of the third antenna device of FIG. 10A.

The first modification of the third antenna device 92 is different from the third antenna device 92 in that, as indicated by a solid line in FIG. 10B, the pair of foil elements 80 are adhered to regions on the both end portions of the plurality of short pieces 74 of the first group in the laminated core member of the magnetic substance 66, the regions facing the back cap 40, and the pair of foil elements 80 extend along the extending directions of the pair of coil non-winding portions 72.

The second modification of the third antenna device 92 is different from the third antenna device 92 in that, as indicated by a two-dots chain line in FIG. 10B, the pair of foil elements 80 are adhered to regions on the both end portions of the plurality of long pieces 76 of the second group in the laminated core member of the magnetic substance 66, the regions facing the back cap 40, and the pair of foil elements 80 extend along the extending directions of the pair of coil non-winding portions 72.

Figure 10C:
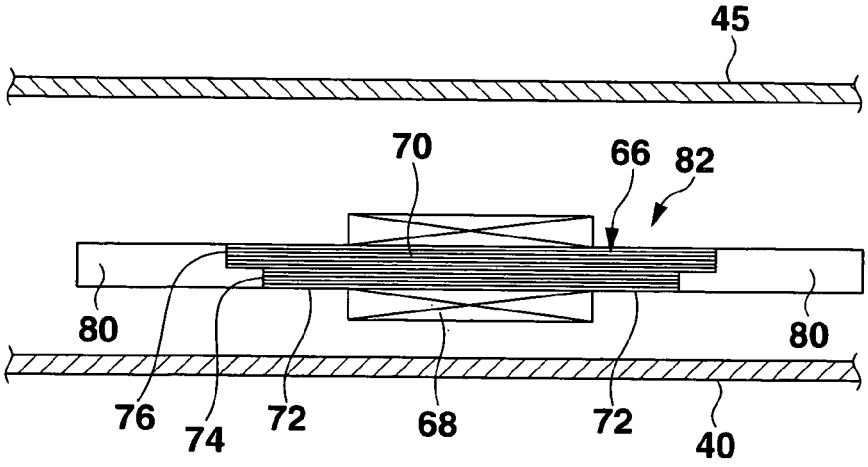
FIG. 10C is an enlarged sectional view of a third modification of the third antenna device of FIG. 10A.

The third modification of the third antenna device 92 is different from the third antenna device 92 in that, as indicated by a solid line in FIG. 10C, the pair of foil elements 80 are adhered to regions on the outer surface of the coil non-winding portions 72 at the both longitudinal end portions of the laminated core member of the magnetic substance 66, the regions facing the inner periphery of the housing space 14, and the pair of foil elements 80 extend along the extending directions of the pair of coil non-winding portions 72.

[Fourth Antenna Device]

Figure 11A:
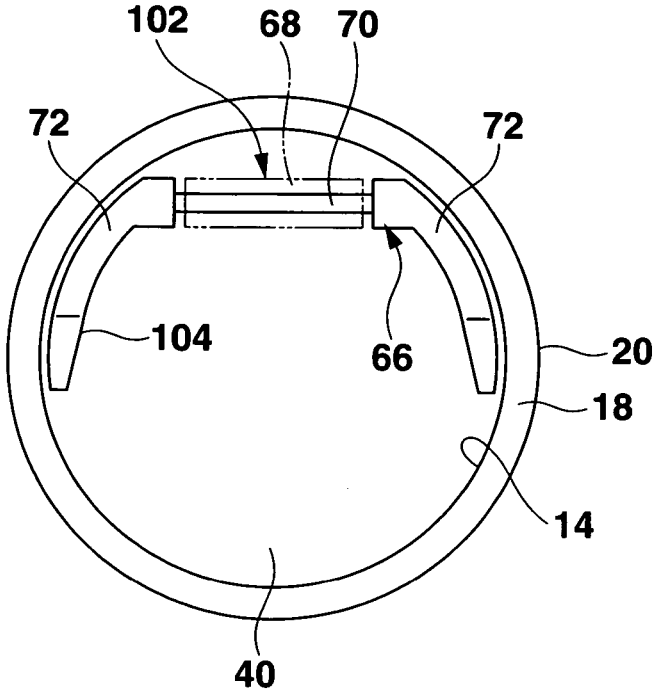
FIG. 11A is an enlarged plan view of a fourth antenna device that can be used in the wristwatch of FIG. 1.

A fourth antenna device 102 that can be used in the electronic equipment 10 shown in FIGS. 1 and 2 will be described with reference to FIGS. 11A and 11B.

Structural members of the fourth antenna device 102 are the same as those of the first antenna device 42 described above with reference to FIGS. 4A and 4B. Therefore, in the fourth antenna device 102, the same structural members as those of the first antenna device 42 are designated by the same reference numerals as those designating those of the first antenna device 42. Detailed descriptions thereof are omitted here.

The fourth antenna device 102 is different from the first antenna device 42 in that the core case 78 is omitted. The coil 68 is wound around the outer surface of the coil winding portion 70 at the center portion of the laminated core member of the magnetic substance 66. The laminated core member is configured by laminating a plurality of sheet plates 104 formed of magnetic material such as an amorphous metal, the sheet plates having different lengths from each other. In the plurality of sheet plates 104 of the laminated core member, the shortest sheet plate 104 is located to be the closest to the back cover 40, and the plurality of sheet plates 104 are laminated so as to be sequentially longer as they approach the decorative plate 45.

Further, the pair of coil non-winding portions 72 at the both end portions of the magnetic substance 66, i.e., the both end portions of the plurality of sheet plates 104 in the laminated core member, are bend so that their distal end regions which are distant from the coil winding portions 70 at the center portion of the magnetic substance 66 are located nearer to the decorative plate 45, i.e., the aperture 16 (refer to FIG. 2) of the housing space 14 of the case 20, than their base regions which are close to the coil winding portions 70 at the center portion of the magnetic substance 66.

In this vending, the receiving sensitivity of the fourth antenna device 102 can be improved more remarkably.

Figure 11B:
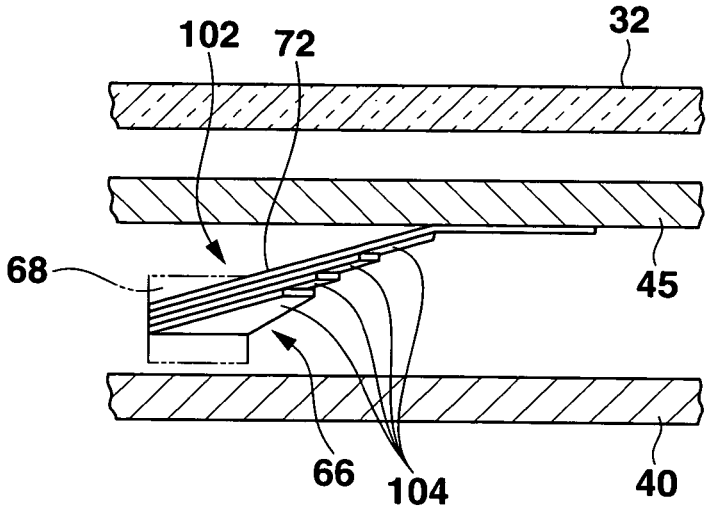
FIG. 11B is a left side view of the fourth antenna device of FIG. 11A.
Figure 11C:
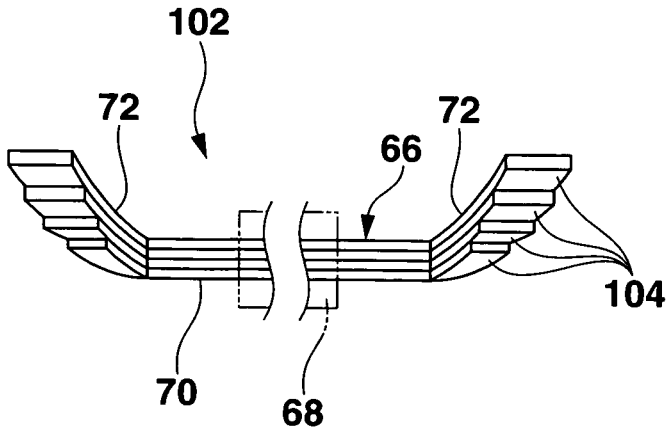
FIG. 11C is a front view of the fourth antenna device of FIG. 11A.

The both end portions of the longest sheet plate 104 that is the closest to the decorative plate 45 in the laminated core member may be brought into contact with or may be adhered to the inner surface of the decorative plate 45, as shown in FIG. 11B.

With this configuration, a surface area of the magnetic substance 66 can be increased without substantially increasing a capacity occupied by the fourth antenna device 102 in the housing space 14 of the case 20, and as a result, the receiving sensitivity of the fourth antenna device 102 can be improved more remarkably.

Further, in the fourth antenna device 102, each of the pair of coil non-winding portions 72 at the both end portions of the magnetic substance 66 is shaped so that the width of each of the distal end regions of the pair of coil non-winding portions 72, the distal end regions being distant from the coil winding portion 70 at the center portion of the magnetic substance 66, is smaller than the width of each of the base regions of the pair of coil non-winding portions 72, the base regions being close to the coil winding portion 70 at the center portion of the magnetic substance 66, when viewed from the surface 18 of the case 20.

Further, with this configuration, the capacity occupied by the fourth antenna device 102 in the housing space 14 of the case 20 can be reduced more remarkably.

[Fifth Antenna Device]

Figure 12A:
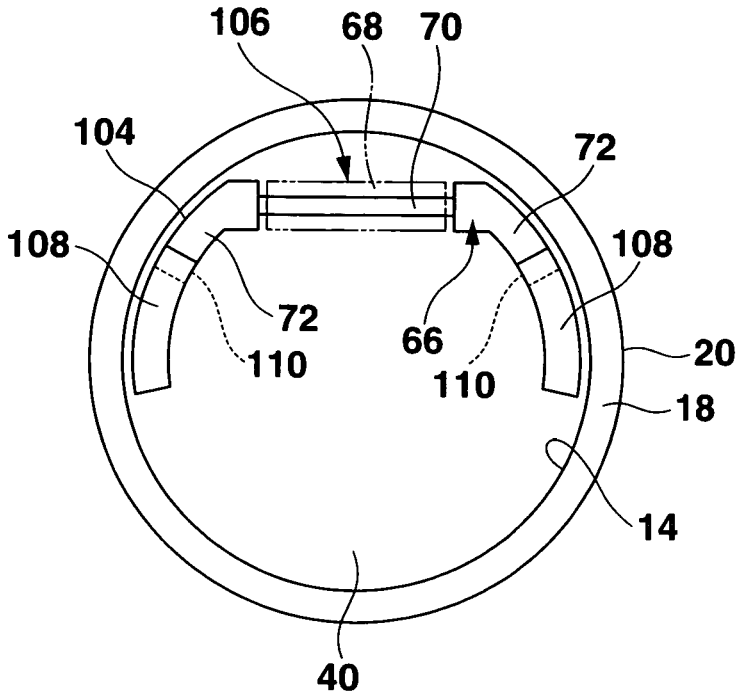
FIG. 12A is an enlarged plan view of a fifth antenna device that can be used in the wristwatch of FIG. 1.
Figure 12B:
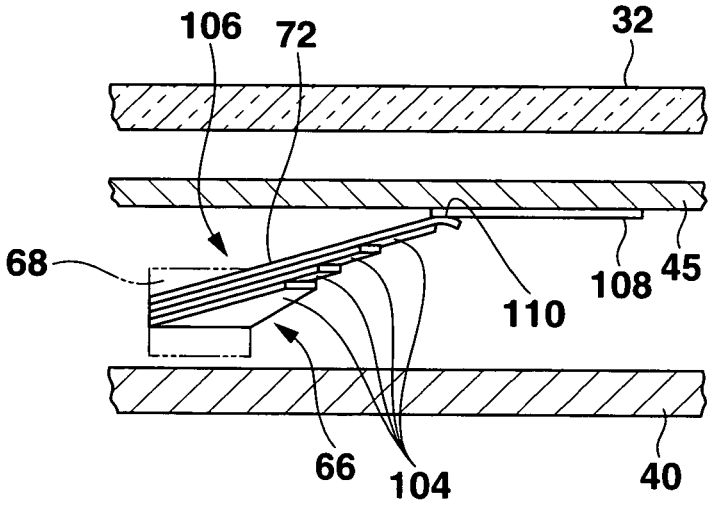
FIG. 12B is an enlarged left side view of the fifth antenna device of FIG. 12A.

A fifth antenna device 106 that can be used in the electronic equipment 10 shown in FIGS. 1 and 2 will be described with reference to FIGS. 12A and 12B.

Structural members of the fifth antenna device 106 are the same as those of the first antenna device 42 described above with reference to FIGS. 4A and 4B. Therefore, in the fifth antenna device 102, the same structural members as those of the first antenna device 42 are designated by the same reference numerals as those designating those of the first antenna device 42. Detailed descriptions thereof are omitted here.

The fifth antenna device 106 is different from the first antenna device 42 in that the core case 78 is omitted. The coil 68 is wound around the outer surface of the coil winding portion 70 at the center portion of the laminated core member of the magnetic substance 66. And, the laminated core member is configured by laminating a plurality of sheet plates 104 formed of a magnetic material such as an amorphous metal, the sheet plates having different lengths from each other. In the plurality of sheet plates 104 of the laminated core member, the shortest sheet plate 104 is located to be the closest to the back cover 40, and the plurality of sheet plates 104 are laminated so as to be sequentially longer as they approach the decorative plate 45.

Further, the pair of coil non-winding portions 72 at the both end portions of the magnetic substance 66, i.e., the both end portions of the plurality of sheet plates 104 in the laminated core member, are bend so that the distal end regions of the pair of coil non-winding portions 72, the distal end regions being distant from the coil winding portion 70 at the center portion of the magnetic substance 66 are located nearer to the decorative plate 45 than the base regions of the pair of coil non-winding portions 72, the base regions being close to the coil winding portion 70 at the center portion of the magnetic substance 66.

With this configuration, the receiving sensitivity of the fifth antenna device 106 can be improved more remarkably.

The pair of coil non-winding portions 72 at the both end portions of the magnetic substance 66 comprises a pair of thin film shaped magnetic members 108 provided on the inner surface of the decorative plate 45 on extending lines of the distal ends of the pair of coil non-winding portions 72. The pair of thin film shaped magnetic members 108 can be formed by adhering a thin film formed of magnetic material such as an amorphous metal, onto the inner surface of the decorative plate 45, by using a variety of publicly known methods, or by coating powders of magnetic material.

The distal ends of the pair of coil non-winding portions 72, i.e., the both ends of the longest sheet plate 104 that is the closest to the decorative plate 45 in the laminated core member are magnetically coupled with the pair of thin film shaped magnetic members 108 by adhesive 110 having magnetic property. The adhesive 110 having magnetic property can be provided, for example by mixing powders of a magnetic substance with usual adhesive that does not have magnetic property.

With this configuration, a surface area of the magnetic element 66 can be increased without substantially increasing a capacity occupied by the fifth antenna device 106 in the housing space 14 of the case 20, and as a result, the receiving sensitivity of the fifth antenna device 106 can be improved more remarkably.

Moreover, the electronic equipment 10 using the fifth antenna device 106 can be easily manufactured. This is because, in a process for manufacturing this electronic equipment 10, the fifth antenna device 106 can be installed to a predetermined location in the housing space 14 of the case 20 while the length of the fifth antenna device 106 is reduced by removing the thin film shaped magnetic member 108 from the magnetic element 66.

For example, the pair of thin film shaped magnetic members 108 are provided in advance at predetermined positions on the inner surface of the decorative plate 45. The fifth antenna device 106 from which the pair of thin film shaped magnetic members 108 are omitted is installed at a predetermined position in the housing space 14 of the case 20. Further, the adhesive 110 having magnetic property is applied to the regions at distal ends of the pair of coil non-winding portions 72, i.e., at the both ends of the longest sheet plate 104 that is the closest to the decorative plate 45 in the laminated core member, the regions facing the decorative plate 45. Alternatively, the adhesive 110 having magnetic property is applied to predetermined regions of the pair of the thin film shaped magnetic members 108. Next, the decorative plate 45 is located at a predetermined position in the aperture 16 of the housing space 14 of the case 20 so that the predetermined regions of the pair of thin film shaped magnetic members 108 on the inner surface of the decorative plate 45 are abutted against the decorative plate facing regions on the distal ends of the pair of coil non-winding portions 72, i.e., the decorative plate facing regions on the both ends of the longest sheet plate 104 that is the closest to the decorative plate 45 in the laminated core member, via the adhesive 110 having magnetic property.

[Sixth Antenna Device]

Figure 13A:
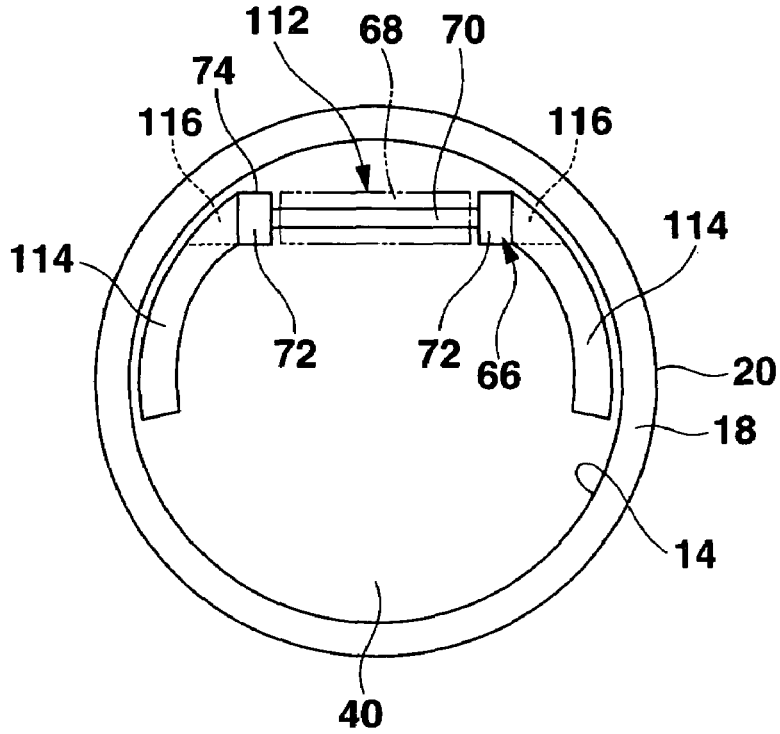
FIG. 13A is an enlarged plan view of a sixth antenna device that can be used in the wristwatch of FIG. 1.
Figure 13B:
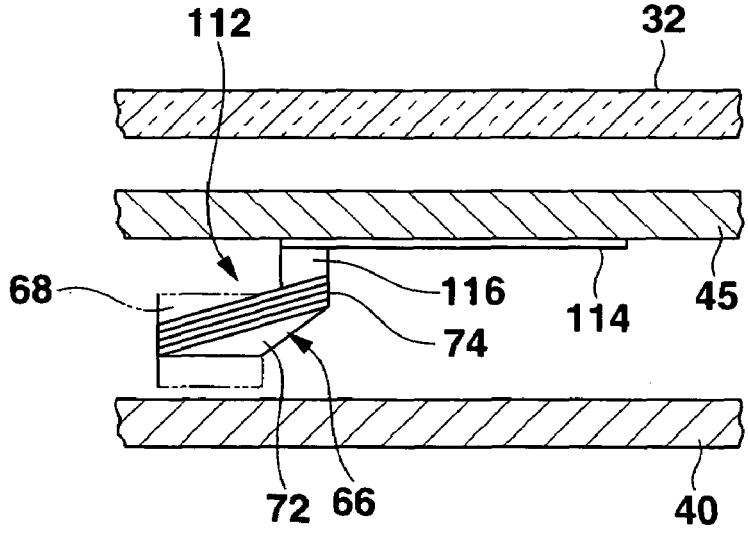
FIG. 13B is an enlarged left side view of the sixth antenna device of FIG. 13A.

Now, a sixth antenna device 112 that can be used in the electronic equipment 10 shown in FIGS. 1 and 2 will be described with reference to FIGS. 13A and 13B.

Structural members of the sixth antenna device 112 are the same as those of the first antenna device 42 described above with reference to FIGS. 4A and 4B. Therefore, in the sixth antenna device 112, the same structural members as those of the first antenna device 42 are designated by the same reference numerals as those designating those of the first antenna device 42. Detailed descriptions thereof are omitted here.

The sixth antenna device 112 is different from the first antenna device 42 in that the core case 78 is omitted. The coil 68 is wound around the outer surface of the coil winding portion 70 at the center portion of the laminated core member of the magnetic substance 66. In addition, the laminated core member is configured by laminating a plurality of short pieces 74 formed of magnetic material such as an amorphous metal, and the lengths of the short pieces 74 are the same as to each other.

Further, the pair of coil non-winding portions 72 at the both end portions of the magnetic substance 66, i.e., the both end portions of the plurality of short pieces 74 in the laminated core member, are bend so that the distal end regions of the pair of coil non-winding portions 72, the distal end regions being distant from the coil winding portion 70 at the center portion of the magnetic substance 66, is located nearer to the decorative plate 45 than the base regions of the pair of coil non-winding portions 72, the base regions being close to the coil winding portion 70 at the center portion of the magnetic substance 66.

With this configuration, the receiving sensitivity of the sixth antenna device 112 can be improved more remarkably.

The pair of coil non-winding portions 72 at the both end portions of the magnetic substance 66 comprises a pair of thin film shaped magnetic members 114 provided on the inner surface of the decorative plate 45 on the extending lines of the distal ends of the pair of coil non-winding portions 72. The pair of thin film shaped magnetic members 114 can be formed by adhering thin films formed of magnetic material such as an amorphous metal onto the inner surface of the decorative plate 45, by using a variety of publicly known methods, or by coating powders of magnetic material.

And, the distal ends of the pair of coil non-winding portions 72, i.e., the both ends of the short piece 74 that is the closest to the decorative plate 45 in the laminated core member, are magnetically coupled with the pair of thin film shaped magnetic members 114 by magnetic spacers 116. The magnetic spacers 116 are formed of material having magnetic property such as an amorphous metal, a ferrite, or permalloy, for example.

The magnetic spacer 116 is adhered to one or both of the distal end of the corresponding coil non-winding portion 72, i.e., the distal end of the corresponding the short piece 74 that is the closest to the decorative plate 45 in the laminated core member, and the corresponding thin film shaped magnetic member 114.

With this configuration, the surface area of the magnetic substance 66 can be increased without substantially increasing the capacity occupied by the sixth antenna device 112 in the housing space 14 of the case 20, and as a result, the receiving sensitivity of the sixth antenna device 112 can be improved more remarkably.

Moreover, the electronic equipment 10 using the sixth antenna device 112 can be easily manufactured. This is because, in a process for manufacturing this electronic equipment 10, the sixth antenna device 112 can be installed at the predetermined position in the housing space 14 of the case 20 while the length of the sixth antenna device 112 is reduced by removing the thin film shaped magnetic members 114 from the magnetic substance 66.

For example, the pair of thin film shaped magnetic members 114 are provided in advance at the predetermined positions on the inner surface of the decorative plate 45. The sixth antenna device 112 from which the pair of thin film shaped magnetic members 114 are removed is installed at the predetermined position in the housing space 14 of the case 20. Further, the magnetic spacers 116 are adhered to the decorative plate facing regions at the distal ends of the pair of coil non-winding portions 72, i.e., the both ends of the short piece 74 that is the closest to the decorative plate 45 in the laminated core member. Alternatively, the magnetic spacers 116 are adhered to the predetermined regions of the pair of thin film shaped magnetic members 114. Next, the decorative plate 45 is located at the predetermined position in the aperture 16 of the housing space 14 of the case 20 so that the predetermined regions of the pair of thin film shaped magnetic members 114 on the inner surface of the decorative plate 45 are abutted against the decorative plate facing regions on the distal ends of the pair of coil non-winding portions 72, i.e., the both ends of the short piece 74 that is the closest to the decorative plate 45 in the laminated core member, via the magnetic spacers 116.

[Modification of Each of the Second to Sixth Antenna Devices 82, 92, 102, 106, and 112]

In each of the second to sixth antenna devices 82, 92, 102, 106, and 112 described above, the coil 68 is directly wound around the coil winding portion 70 at the center portion of the magnetic substance 66. However, the coil winding portion 70 may be covered with a cover formed of material having magnetic permeability such as synthetic resin, and the coil 68 may be wound around this cover.

[Modification of the Magnetic Substance 66]

The magnetic substance 66 of each of the second to sixth antenna devices 82, 92, 102, 106, and 112 described above includes the laminated core member. However, the magnetic substance 66 may be a core member integrally molded with material having magnetic property such as amorphous metal, a ferrite, or permalloy, for example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the magnetic substance comprises a core member that includes the coil winding portion and the pair of coil non-winding portions;

wherein the core member comprises a laminated core member that includes a plurality of sheet plates, each of which is formed of a magnetic material and is mutually laminated;

wherein the plurality of sheet plates of the laminated core member are classified into a plurality of groups, each of which has a length different from another length in a longitudinal direction thereof; and wherein the plurality of groups of the plurality of sheet plates of the laminated core member are combined so that the lengths decrease step by step from a group that is closest to the surface of the case along a depth direction of the housing space to a group that is most distant from the surface of the case when the antenna device is housed in the housing space of the case of the electronic eguipment.

2. The antenna device according to claim 1, wherein each of the coil non-winding portions is shaped so that a width of a distal end region thereof which is distant from each of the both ends of the coil winding portion is smaller than a width of a base region thereof which is close to each of the both ends of the coil winding portion, when the antenna device is housed in the housing space of the case of the electronic equipment and is viewed from the surface of the case.

3. The antenna device according to claim 1, wherein each of the coil non-winding portions is bent so that a distal end region thereof which is distant from each of the both ends of the coil winding portion is located closer to the surface of the case than a base region thereof which is close to each of the both ends of the coil winding portion, when the antenna device is housed in the housing space of the case of the electronic equipment.

4. An electronic equipment comprising:

a case including a housing space and a surface in which an aperture is formed, the aperture allowing access from an external space to the housing space;

an antenna device housed in the housing space of the case, wherein the antenna device comprises:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion; and wherein at least one of the coil non-winding portions is curved in an arc shape toward a distal end thereof from a base thereof so as to extend along an inner peripheral surface of the housing space when the antenna device is housed in the housing space and is viewed from the surface of the case;

an electric circuit unit housed in the housing space of the case, electrically connected to the antenna device, and controlled based on a signal inputted from the antenna device; and a decorative plate closing the aperture;

wherein the pair of coil non-winding portions of the magnetic substance comprises thin film shaped magnetic members provided on an inner surface of the decorative plate; and wherein a magnetic spacer is interposed between the thin film shaped magnetic member of each of the pair of coil non-winding portions of the magnetic substance and another region of each of the pair of the coil non-winding portions of the magnetic substance, and the magnetic spacer magnetically couples the thin film shaped magnetic member of each of the pair of coil non-winding portions of the magnetic substance and the other region of each of the pair of the coil non-winding portions of the magnetic substance with each other.

5. The electronic equipment according to claim 4, wherein the electronic circuit unit includes a clock circuit generating a clock signal controlled based on the signal inputted from the antenna device.

6. The electronic equipment according to claim 4, wherein the case comprises a pair of band attaching portions to which both ends of one watch band or proximal ends of a pair of watch bands are adapted to be attached.

7. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case; and wherein each of the coil non-winding portions is shaped so that a dimension taken along a depth direction of the housing space in a distal end region of each of the coil non-winding portions, which is distant from each of the both ends of the coil winding portion, is smaller than that in a base region of each of the coil non-winding-portions, which is close to each of the both ends of the coil winding portion, when the antenna device is housed in the housing space of the outer case of the electronic equipment.

8. The antenna device according to claim 7, wherein each of the coil non-winding portions is shaped so that a width of a distal end region thereof which is distant from each of the both ends of the coil winding portion is smaller than a width of a base region thereof which is close to each of the both ends of the coil winding portion, when the antenna device is housed in the housing space of the case of the electronic equipment and is viewed from the surface of the case.

9. The antenna device according to claim 7, wherein each of the coil non-winding portions is bent so that a distal end region thereof which is distant from each of the both ends of the coil winding portion is located closer to the surface of the case than a base region thereof which is close to each of the both ends of the coil winding portion, when the antenna device is housed in the housing space of the case of the electronic equipment.

10. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the coil winding portion comprises a core member;

wherein the pair of coil non-winding portions comprise at least one pair of foil elements which protrude in an outward direction from both ends of the core member of the coil winding portion and which are magnetically coupled with the both ends of the core member; and wherein a magnetic permeability of each of the foil elements is smaller than that of the core member.

11. The antenna device according to claim 10, wherein each of the foil elements includes an amorphous metal.

12. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the coil winding portion comprises a core member;

wherein the pair of coil non-winding portions comprise at least one pair of foil elements which protrude in an outward direction from both ends of the core member of the coil winding portion and which are magnetically coupled with the both ends of the core member;

wherein the core member is housed in a core case formed of synthetic resin, the core case being wound with the coil; and wherein the at least one pair of foil elements are magnetically coupled with the both ends of the core member via the core case.

13. The antenna device according to claim 12, wherein a magnetic permeability of each of the foil elements is smaller than that of the core member.

14. The antenna device according to claim 12, wherein each of the foil elements includes an amorphous metal.

15. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the coil winding portion comprises a core member;

wherein the pair of coil non-winding portions comprise at least one pair of foil elements which protrude in an outward direction from both ends of the core member of the coil winding portion and which are magnetically coupled with the both ends of the core member;

wherein the core member is housed in a core case formed of synthetic resin, the core case being wound with the coil;

wherein a gap is produced between the core case and each of the both ends of the core member; and wherein each of the at least one pair of foil elements are inserted into the gap between the core case and each of the both ends of the core member.

16. The antenna device according to claim 15, wherein a magnetic permeability of each of the foil elements is smaller than that of the core member.

17. The antenna device according to claim 15, wherein each of the foil elements includes an amorphous metal.

18. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the aperture of the housing space of the electronic equipment is closed with a decorative plate;

wherein each of the pair of coil non-winding portions of the magnetic substance comprises a thin film shaped magnetic member provided on an inner surface of the decorative plate; and wherein the thin film shaped magnetic member of each of the pair of coil non-winding portions of the magnetic substance is magnetically coupled with another region of each of the pair of coil non-winding portions by an adhesive having a magnetic property.

19. An antenna device adapted to be installed in a case of an electronic equipment, the case including a housing space for housing the antenna device and a surface in which an aperture is formed, and the aperture allowing access from an external space to the housing space, the antenna device comprising:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion;

wherein at least one of the coil non-winding portions is curved in an arc shape toward a distal end thereof from a base thereof so as to extend along an inner peripheral surface of the housing space when the antenna device is housed in the housing space and is viewed from the surface of the case;

wherein the aperture of the housing space of the electronic equipment is closed with a decorative plate;

wherein each of the pair of coil non-winding portions of the magnetic substance comprises a thin film shaped magnetic member provided on an inner surface of the decorative plate; and wherein a magnetic spacer is interposed between the thin film shaped magnetic member of each of the pair of coil non-winding portions of the magnetic substance and another region of each of the pair of the coil non-winding portions of the magnetic substance, and the magnetic spacer magnetically couples the thin film shaped magnetic member of each of the pair of coil non-winding portions of the magnetic substance and the other region of each of the pair of the coil non-winding portions of the magnetic substance with each other.

20. An electronic equipment comprising:

a case including a housing space and a surface in which an aperture is formed, the aperture allowing access from an external space to the housing space;

an antenna device housed in the housing space of the case, wherein the antenna device comprises:

a magnetic substance; and a coil wound around the magnetic substance;

wherein the magnetic substance includes a coil winding portion, around which the coil is wound, and a pair of coil non-winding portions, which protrude from both ends of the coil winding portion, around each of which the coil is not wound, and which are magnetically coupled with the coil winding portion; and wherein at least one of the coil non-winding portions is curved in an arc shape toward a distal end thereof from a base thereof so as to extend along an inner peripheral surface of the housing space when the antenna device is housed in the housing space and is viewed from the surface of the case;

an electric circuit unit housed in the housing space of the case, electrically connected to the antenna device, and controlled based on a signal inputted from the antenna device; and a decorative plate closing the aperture;

wherein the pair of coil non-winding portions of the magnetic substance comprises thin film shaped magnetic members provided on an inner surface of the decorative plate; and wherein the thin film shaped magnetic member of each of the pair of coil non-winding portions of the magnetic substance is magnetically coupled with another region of each of the pair of coil non-winding portions by an adhesive having a magnetic property.

21. The electronic equipment according to claim 20, wherein the electronic circuit unit includes a clock circuit generating a clock signal controlled based on the signal inputted from the antenna device.

22. The electronic equipment according to claim 20, wherein the case comprises a pair of band attaching portions to which both ends of one watch band or proximal ends of a pair of watch bands are adapted to be attached.

* * * * *